United States Patent [19]

Biron

[11] 3,937,492

[45] Feb. 10, 1976

[54] SYSTEM OF VERIFIED COMMUNICATION

[76] Inventor: Normand R. Biron, 2210 N. Mill St., Lewisville, Tex. 75067

[22] Filed: Mar. 7, 1973

[21] Appl. No.: 338,978

[52] U.S. Cl. ..... 282/25; 229/73
[51] Int. Cl.[2] ..... B41L 1/20
[58] Field of Search..... 281/25; 283/1 B; 229/73

[56] References Cited

UNITED STATES PATENTS

| | | | |
|---|---|---|---|
| 1,244,912 | 2/1919 | Irvin et al. | 282/25 |
| 1,957,704 | 5/1934 | Drachman | 229/73 |
| 2,156,142 | 4/1939 | Blitz | 282/25 |
| 2,212,587 | 8/1940 | Cronauer | 229/73 |
| 2,485,261 | 10/1949 | Cravens | 282/25 |
| 3,164,317 | 1/1965 | Bogen | 229/73 |
| 3,186,735 | 6/1965 | Hanrahan | 282/25 |
| 3,306,632 | 2/1967 | Stahmer | 282/25 |
| 3,312,385 | 4/1967 | Amort | 229/73 |
| 3,693,869 | 9/1972 | Eaves | 229/73 |

FOREIGN PATENTS OR APPLICATIONS

| | | | |
|---|---|---|---|
| 29,907 | 1912 | United Kingdom | 229/73 |

*Primary Examiner*—Jerome Schnall
*Attorney, Agent, or Firm*—Richards, Harris and Medlock

[57] ABSTRACT

A specialized mailing instrument having an envelope portion and a cover portion adapted to overlie the envelope portion in a folded condition. The exterior of the cover has a space for addressee information and the reverse side has space for return information. Transfer means such as carbon contact paper, underlies the addressee panel so that information impressed on the addressee panel, including recipient acknowledgments, if requested by the sender, is transferred to the envelope portion and the enclosed document for verification. The cover is perforated for removal upon receipt and foldable with the return address showing for return and verification to the sender. A security window may be provided to permit inspection of the contents of the envelope. The instrument may be partially pre-printed for large volume users and may include a detachable notice of attempted mail delivery. The instrument is also suitably provided with identifying distinctive markings and appropriate instruction as to use. Another form of the invention is adapted for mailing of specialized documents such as checks and has a cover with appropriate cutouts exposing address information and postage placed on the enclosed document.

5 Claims, 8 Drawing Figures

SYSTEM OF VERIFIED COMMUNICATION

The present invention relates to a system of verified communication and more particularly relates to a security mailing instrument having an envelope portion for containing a document and designed so that information as to mailing and receipt is recorded on the enclosed documents. Another aspect of the invention provides as part of the mailing instrument a portion which is adapted to be removed and returned to the sender as proof of receipt.

The prior art discloses a number of special purpose mailing instruments for various uses. Most of these special purpose instruments are to accommodate banking services. For example, U.S. Pat. No. 2,831,707 shows an envelope assembly having a flap portion adapted to overlie a check portion. The flap is provided with a window opening so that information on the check, such as the name and address of the payee, will be visible when folded and placed in the mail. The check portion has provision for insertion of a sheet of carbon paper and a stub beneath the check to reproduce the written material on a check for record purposes.

Numerous other patents may be found in the prior art which show combined letter-check envelope assemblies to reduce the time required to prepare and mail checks. The general prior art construction utilizes a window, such as described above with reference to the above-referred patent, so that information placed on the check in completing the instrument is transferred to a stub for record keeping purposes and with address information exposed when the envelope is folded.

In addition to expediting mailing procedure, a requirement for many mail users is proof of mailing and additionally the assurance that the letter or document mailed has properly reached its destination. A common means of determining proper delivery is the use of registered or certified mail. Certified and registered mail procedures which provide the sender with proof of mailing require the placement of a gummed, addressed receipt on the article or envelope. If the sender wants a returned receipt he must insert the sender's name and address on the return receipt card and endorse the front of the card requesting a return receipt. When the article is delivered to the addressee, the addressee must sign the attached stub which is removed by the postal employee and placed in the mail to the sender. The receipt of the signed stub by the sender is an acknowledgment of receipt of the article or letter by the proper addressee.

The present invention provides a mailing instrument which is economical and efficient and which can be used so that information placed on the envelope can be transferred or or reproduced on the enclosed document in a single operation. Further, the preferred embodiment of the mailing instrument of the present invention includes as an integral part, a removable portion which can easily be severed at time of delivery and placed in the mail addressed to the sender. The sender is thus provided with a receipt carrying the original address of the addressee, the postal stamp and cancellation and, if requested, the signature of the addressee. All of this information provides the sender with proof of mailing and receipt.

The present invention provides an integral mailing instrument having an envelope portion with a flap adapted to be sealed overlying the envelope portion.

The flap has parallel perforations which define a removable tab portion. The addressee's name and address appear on the outer side of the tab. The inner side of the tab is addressed for return to the sender. A reporduction section underlies the addressee portion so that the addressee information and postage mark is transferred to the enclosed document. Space is provided for signature of the addressee upon receipt which is also transferred to the enclosed document. The tab is separated from the envelope assembly and folded for return to the sender with the return address information exposed.

The mailing instrument is preferably provided with distinctive identifying markings and appropriate instructions to the carrier as to use. The instrument may be partially preprinted for large volume users. A tab may be included carrying a notice of attempted mail delivery which can be detached and placed in the addressee's mail box.

Another embodiment of the present invention is adapted for mailing checks and legal documents with information on the document exposed through a cutout for mailing purposes. Another opening in the envelope is provided so that the postal cancellation is placed directly upon the enclosed document for record purposes.

The mailing instrument of the present invention provides both the economy and efficiency of multiple purpose envelope arrangements and further provides the advantages of verified receipt without the requirement of present certification and registration procedures. The above and other advantages will become apparent from the following specification, claims and drawings, in which:

Figure 1:
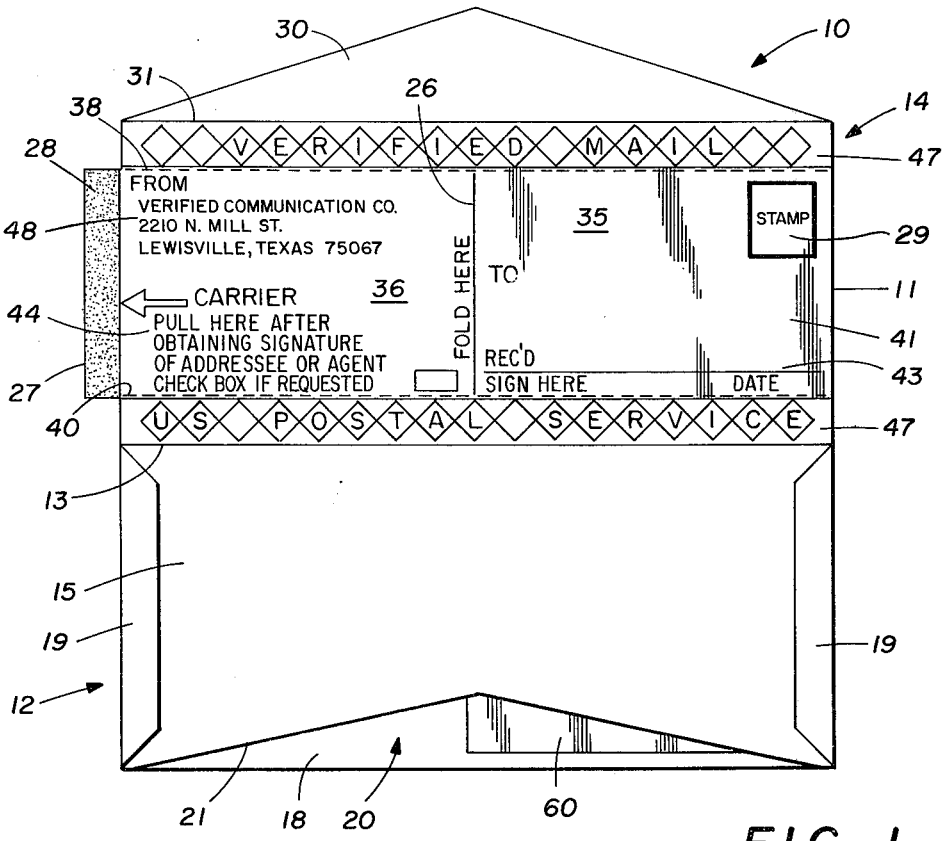
FIG. 1 is a plan view of one side of the communication assembly of the present invention.

Referring to FIGS. 1 through 4, a first embodiment of the mailing instrument of the present invention is shown. The mailing instrument is generally designated by the numeral 10 and comprises a generally rectangular body 11 divided at transverse fold line 13 into an envelope or pouch portion 12 and cover portion 14. Pouch portion 12 is formed by outer sheet 15 and inner sheet 18 being joined at edges 19. A pocket 20 is formed between sheets 15 and 18 adapted for reception of a letter or other document. To facilitate insertion of such a document, outer sheet 15 has a conventional V-shaped edge 21. Sheets 15 and 18 may be affixed to one another adjacent fold line 13 or simply may be left unattached as documents will be held securely in pocket 20 by the fold line 13 when the instrument is assembled and sealed.

Cover portion 14 of the instrument is subdivided into adjacent areas 35 and 36 by vertical fold line 26. A sealing flap 30 extends from the upper edge of portion 14 at fold line 31. Adhesive edge 32 is provided along one edge of flap 30 for sealing the instrument. Parallel spaced perforations 38 and 40 extend transversely across the surface of cover panel 14. Area 35 has space for addressing the instrument. The name, address and zip code of the addressee can be inserted in the space generally designated 41. This can be placed on the panel by typing or can be printed in handwriting. The lower portion of area 35 carries line 43 which is provided for the signature of the addressee and date of receipt upon receipt by the addressee. Area 35 also has an area in the upper right hand corner designated 29 for placement of postage and recording the postal cancellation.

Left-hand area 36 has an area generally designated 48 for the return address of the sender. Tab 27 extends from the left side of area 36 and has adhesive surface 28 for sealing. Area 48 on area 36 may either be filled in by the sender or for large volume users of the instrument, may be preprinted with the name, address and zip code of the sender. Instructional information to the carrier can be provided in space 44 on area 36. The sender may indicate at this location whether he desires endorsement by the addressee upon receipt.

In the folded condition, areas 35 and 36 will be part of the exterior of the folded instrument. As will be explained in detail hereafter, upon proper delivery and endorsement by the addressee, if requested, the carrier will sever areas 35 and 36 from portion 14 by ripping along perforations 38 and 40. In order that the specialized mailing instrument of the present invention can be easily identified by the mail carrier, distinctive markings and colorings 47 are preferably provided on the surface of areas 35 and 36.

Figure 2:
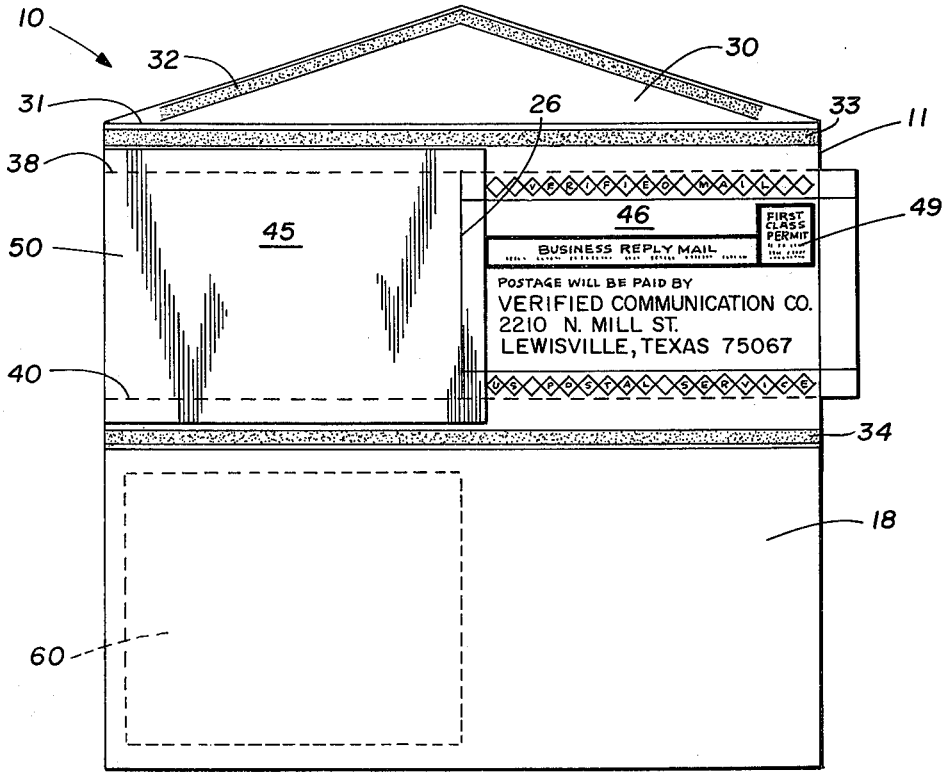
FIG. 2 is a plan view of the opposite side of the assembly shown in FIG. 1.

FIG. 2 shows the opposite side of portion 11 which forms the interior of the envelope in a folded condition. Area 46 which corresponds to the rear of area 36 carries a space for the sender's address. Large volume users may preprint this space with the proper address and zip code. Return postage is carried in the upper right-hand corner 49 of area 46. Again, large volume users may preprint this portion of the instrument carrying the identification of the postal permit. Left-hand interior area 45 corresponds to the rear of area 35. Reproducing means 50 covers the rear of area 45 and forms part of a reproduction system which serves to transfer information impressed on the exterior of area 35 to the envelope portion 12. The inner side of sheet 18 of pouch portion 12 is formed with reproducing means 60 such as a reproducing coating. It will be seen, that any document within pocket 20 of the envelope will have a portion adjacent reproducing means 60 when the envelope is in a folded condition. Impression marking will be transferred by reproducing means 60 to the enclosed document. Reproducing means 50 and 60 may be any of a variety of image transferring media such as carbon or non-carbon reproduction paper. Alternatively a reproducing means could be placed only at 60, relying on the pressure of the exterior marking for transfer.

Parallel adhesive surfaces 33 and 34 extend across areas 45 and 46 adjacent perforations 38 and 40. These adhesive surfaces seal the cover and envelope portions to one another when the instrument is assembled. The adhesive is preferably protected with a peelable tape which is removed when the instrument is sealed. The adhesive surfaces 33 and 34 also insure the document within the envelope remains sealed after the return portions of the cover have been severed.

In use, areas 36 and 46 are completed with the insertion of the sender's name, address and zip code. As pointed out above, in the case of some users this information may be preprinted when the mailing instrument 10 is manufactured. Postage is placed at space 29 and return postage is applied at space 49 provided on area 46. The envelope is then doubled over and folded along line 13. The cover is then attached to the envelope by adhesive surfaces 33 and 34. Document 55 is inserted within pocket 20 of the envelope 12.

Document 55 is folded so that the exposed portion adjacent reproducing means 60 is a location where the sender desires the receipt information to be impressed. The sender then simply seals the envelope by folding flap 30 over outer sheet panel 15 and moistening adhesive edge portion 32. The instrument is then appropriately filled in with the addressee's name and address in space 41 provided on area 35 and this information is, at the same time, transferred to the envelope and enclosed document 55. Postage is applied in the upper right-hand corner of area 35 and the assembly is placed in a postal letter box for delivery. Note that there is no requirement that the individual go to the post office for verification and registration procedures. Further, the postal department is not required to place identification numbers on the envelope and maintain a record of the document as is necessary with present procedures.

Figure 4:
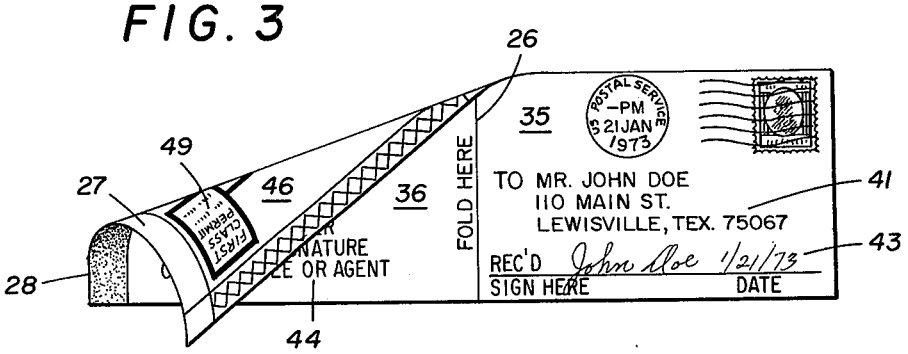
FIG. 4 is a view of the return tab portion of the envelope assembly after severance from the envelope.

When the instrument is delivered to the addressee, the addressee, if requested by the sender as noted on area 36, will place his signature and date of receipt, along with any other desired information, at the appropriate space 43 on exterior area 35. Reproducing means 50 and 60 will transfer this information to the adjacent portion of the sealed envelope and document 55 therein. Similarly, the postage cancellation mark will have previously been transferred to the enclosed document by virtue of the reproducing means 50 and 60. Upon completion of the line 43 by the addressee, the letter carrier will note the instructions in space 44 on the outer surface of the envelope and will simply grasp the left-hand tab 27 tearing areas 36 and 35 from the assembly, as best seen in FIG. 4. Areas 36 and 35 are folded back on one another along fold line 26 with area 46 on the exterior and sealed against one another with adhesive 28 on tab being affixed to the edge of area 35. The severed and folded cover panel is then dropped in the mail with the address of the sender and the postage appearing at area 46. The cover will be returned to the sender by the normal course of the mail. Area 35, accompanying the returned portion, contains the name and address of the recipient, the postal cancellation mark and, if requested by the sender, the date of receipt and signature of the recipient. Upon receipt of cover portion 14, the sender has proof of mailing and, if he requested it, has the acknowledgment and endorsement of the recipient as evidenced by the recipient's signature at line 43.

The distinctive markings 47 on the exterior of the envelope call to the attention of the letter carrier the specialized nature of the communication so that he will be alerted to the special handling requirements; obtaining the addressee's endorsement and severing and returning panels 35 and 36.

Figure 3:
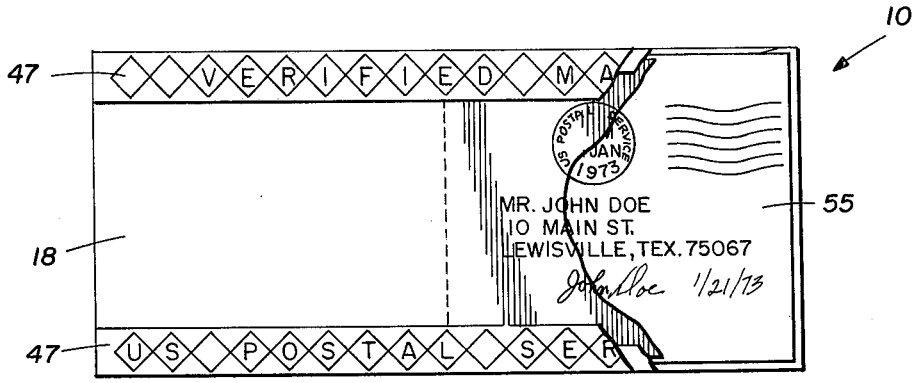
FIG. 3 is a view of the assembly of the present invention in a sealed condition after the return tab portion has been removed with a portion of the envelope partly broken away to expose the contents of the assembly.

As seen in FIG. 3, document 55, which is retained by the addressee, carries an imprint of the identical information returned to the sender. Should a question arise about the date of receipt or the legitimacy of the document, the information on the document and the information on the cover in the possession of the sender can be compared.

Figure 5:
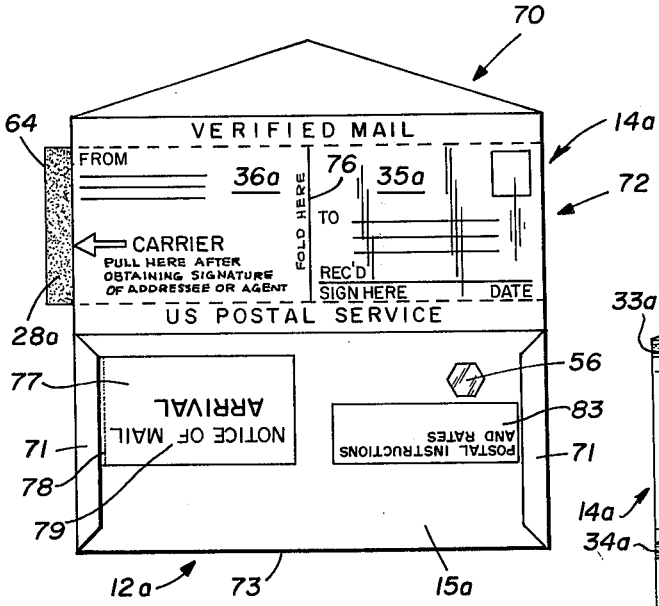
FIG. 5 is a plan view similar to FIG. 1 showing another embodiment of the present invention.
Figure 6:
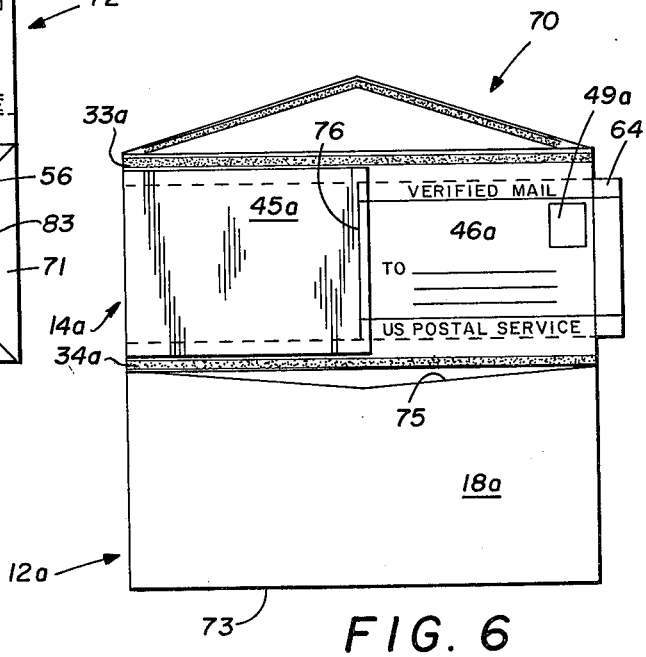
FIG. 6 is a plan view showing the opposite side of the embodiment shown in FIG. 5.

FIGS. 5 and 6 show views of an alternate embodiment of the mailing instrument of the present invention and is generally designated by the numeral 70. In this embodiment, like numbers are used to identify elements similar or identical to those previously described and are distinguished by appended letters. Instrument 70 is comprised of a cover portion 14*a* and an envelope 12*a*. Envelope 12*a* is formed of a single sheet folded at edge 73 to form sheets 15*a* and 18*a* sealed along marginal tabs 71. The envelope pocket opens at 75. The exterior of cover 14*a* is divided into areas 35*a* and 36*a* for addressee and return information. Similarly, interior area 46*a* is provided with space for insertion of return information and postage at 49*a*.

As a security device, small window 56 is provided in one corner of sheet 15*a*. Security window 56 is provided for the use of the recipient of the letter. The recipient may view the partial contents of the envelope to ensure that a document is, in fact, inserted in the envelope pocket. This is to prevent misuse and fraudulent use of the verified system of communication by the sender. In other respects, the construction and use of the embodiment 70 is the same or similar to that described with reference to FIGS. 1 and 2, and identical numbers with an appended "*a*" are used to identify those components.

As seen in FIG. 5, embodiment 70 also carries a tab 77 on the exterior side of envelope portion 12a. Tab 77 is detachable at perforations 78 and carries a legend 79 advising the addressee of attempted mail delivery. In the situation where the sender has requested addressee endorsement and the addressee is not available at time of delivery, tab 77 is severed and placed in the addressee's mailbox advising him that he may receive the letter at a designated postal station.

Informational area insert 83 can contain information as to the postal rates for the verified communication system. This is to assist the sender. For example, the postal rate may vary depending on the service requested by the sender; a higher rate being applicable when the addressee's endorsement upon receipt is required.

Figure 7:
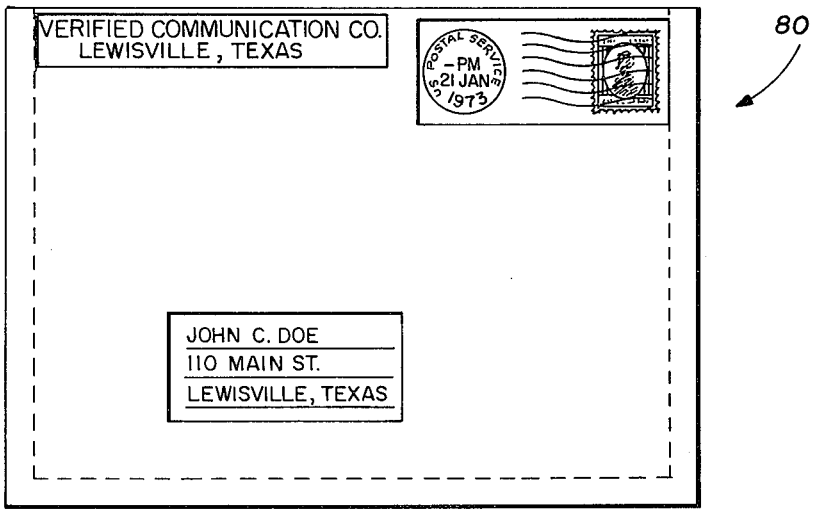
FIGS. 7 and 8 show still another embodiment of the present invention.
Figure 8:
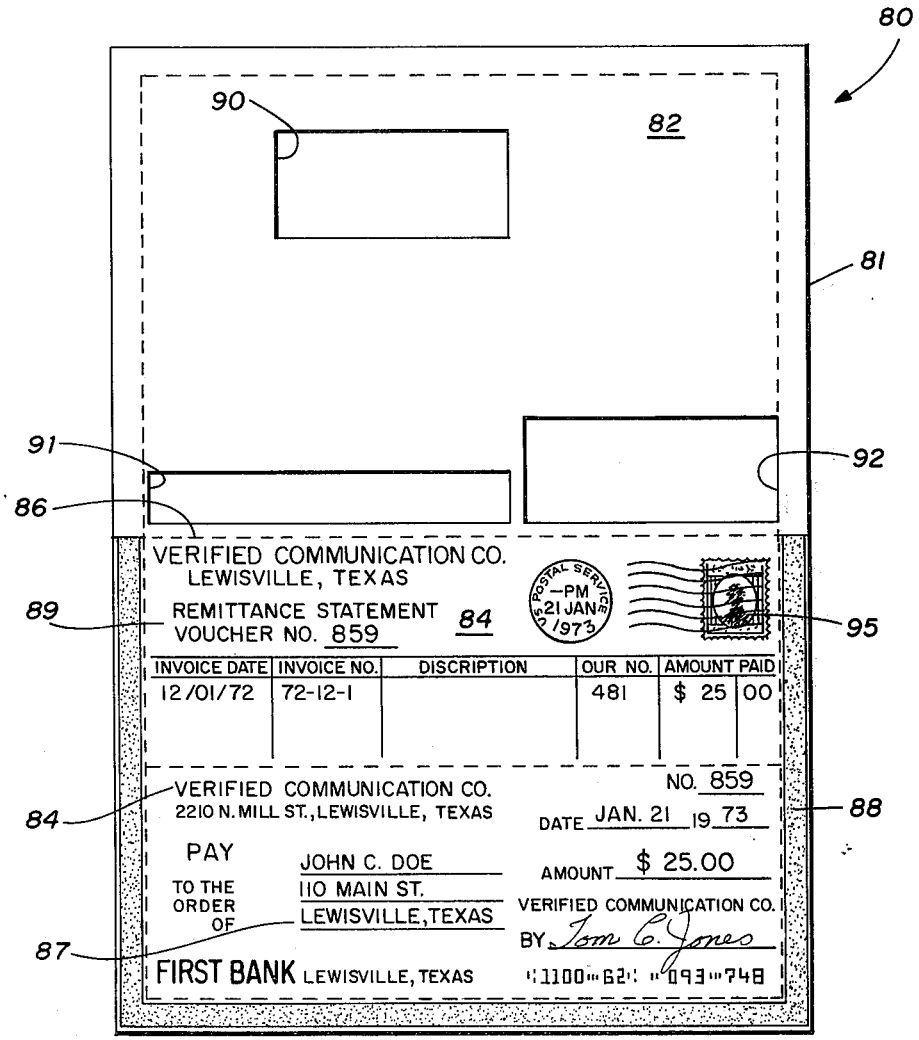

A somewhat different embodiment of the present invention is shown in FIGS. 7 and 8 and is generally designated by the numeral 80. This embodiment incorporates some of the features of the embodiments of the foregoing figures but does not have provision for return notice to the sender. The present instrument is used primarily when the sender only requires that proof of posting be transmitted directly to the enclosed document. Embodiment 80 is formed from generally rectangular sheet 81 divided into cover section 82 and document section 84 along transverse fold line 86. The interior surface of document section 84 may be at least partially preprinted in a conventional manner for specialized uses. For example, section 84 may be preprinted as a check form showing the name of the bank in which the check is drawn and include spaces for the insertion of the date, the amount to be paid, the check drawers signature and other identification symbols. For other specialized applications document section 84 may be suitably preprinted including a lined portion 87 at a predetermined area in which the name and address of the addressee may be inserted. Three marginal edges of document sections 84 are provided with a layer of a pressure sensitive adhesive 88 of any suitable type. Typically, adhesive 88 would be of a glue on tape having a peelable protective covering which can be removed when it is desired to use the document. Cover section 82 of mailing instrument 80 is desirably apertured with openings 90 91 and 92. Opening 90 is located in document cover section 80 so that it is directly alignable with address section 87 of document portion 84 when the portions are folded over in face-to-face engagement along fold line 86. Similarly, opening 91 is located to reveal the return address at 89.

Opening 92 occupies a position corresponding to the location where a stamp would be placed at the exterior side of cover 82 so that the postage stamp 95 can be placed on document 84 and appear at opening 92 when the instrument is folded as seen in FIG. 7. Alternately, an ordinary letter or other document could simply be folded and be positioned on document section 84 with the name and the proper address of the addressee occupying a position viewable at 90 and the stamp appearing at 92. Instrument 80 is then folded along fold line 86 with cover section 82 being brought in overlying engagement with portion 84. It will be observed that the name and the address of the addressee, as seen in FIG. 7, will be completely visible through opening 90. The envelope is then sealed by removing protective covering on pressure sensitive adhesive portion 88. The instrument can be dropped in the mail and when the postal cancellation mark is applied with a stamp at location 95, the postmark will be placed directly on the exposed portion of document 84. Therefore, it will be appreciated that the embodiment 80 provides several advantages. The necessity of writing the name and address on the check or included communication and also on the envelope can, in most cases, be avoided. Further, the date of mailing, which in many situations may be of importance, can be printed directly on the included document and is available as evidence of date of mailing.

The embodiment 80 is particularly useful as a check mailing instrument with a voucher as seen. The lower check portion, when negotiated, returns to the drawer via his bank with the recipient's endorsement. The recipient, on the other hand, returns the voucher with date of mailing as evidenced by the postage cancellation at location.

The advantages of the mailing instrument of the present invention are numerous. The assembly of the present invention is an integral mailing instrument which can be easily adapted to the special requirements of the sender. There is no need to attach special stubs for return receipt or visit the post office to obtain registry of a letter. The postal service responsibility in handling letters or documents in the mailing assembly of the present invention is substantially reduced. The post office is not required to keep costly and voluminous records presently required for certified and registered mail handling.

Another important advantage of the invention is that the addressee's signature can be reproduced on the enclosed document when the mailing receipt is signed. This gives an added security feature since the document can be confirmed by a comparison of the style of signature on the return receipt and the document itself. Further security features include a visible window of a portion of the envelope assembly to permit the addressee to inspect the contents of the envelope at least to the extent to determine that a document is in fact enclosed. The sender has the advantage of receiving as part of his return receipt a portion of the original envelope on which the addressee's address is placed. The cancellation postmark is also returned to the sender and is also transferred to the enclosed document for matching and date confirmation purposes.

Thus, in view of the foregoing, it will be seen that the present mailing instrument provides a number of advantages over the prior art. The mailing instrument of the present invention may provide a signed, dated and properly addressed postmarked receipt, returned to the sender verifying proper receipt of the document. The enclosed document itself is provided with the same information for comparison and security purposes.

It will be obvious to those skilled in the art to make various changes, modifications, and alterations to the construction shown. It is intended that such changes are within the scope of the present invention and that the present invention be limited only by a fair interpretation of the appended claims.

What is claimed is:

1. A mailing instrument comprising:

a body formed of sheet material separated by parallel spaced fold lines into an envelope portion, a cover portion, and a sealing flap portion;

said envelope portion having a pocket for receiving a document therein and a pressure-sensitive reproducing means on the interior of said pocket whereby information markings made on the exterior of said envelope will be likewise formed on said document when said document is in said pocket;

adhesive on one side of said flap portion;

said cover portion being positioned between said envelope portion and said flap portions, said cover portion being of a size to fold adjacent to and over one side of said envelope portion whereby said flap can be folded along the other side of said envelope portion and adhesively attached thereto thereby sealing said pocket for mailing;

pressure sensitive reproducing means on one side of said cover portion positioned coextensive with said reproducing means on the inside of said pocket when said cover portion is folded to said mailing position whereby markings made on said cover portion will be likewise formed on said envelope portion when said cover portion is folded to said mailing position;

adhesive material on said one side of said cover portion adjacent to said fold lines for attachment to said one side of said envelope portion when said cover portion is in said mailing position; and a pair of spaced weakened tear lines extending across said cover portion between the side edges of said cover portion and positioned between said adhesive portions whereby the part of said cover portion between said tear lines may be detached from said instrument, an informational spaces on said other side of said cover portion between said tear lines adapted for addressee information and endorsement by the recipient whereby said reproducing means on said cover transfers said information written in said informational spaces to the envelope portion and said reproducing means on said pocket transfers said information to said document in said envelope portion and an information space on said one side of said cover portion between said tear lines adapted for return address information so that said detached part may be mailed back to the sender.

2. The instrument as defined in claim 1 wherein said detachable part of said cover portion has a fold line which extends across said detachable part allowing said part to be folded, and an informational space on said detachable part for return addressor information which is exposed when said part is folded whereby the endorsement by the recipient can be returned to the sender.

3. The instrument as defined in claim 1 additionally comprising an informational space on said cover portion between said tear lines adapted for Post Office cancellation information whereby said cancellation information is transferred to said cover and said document by said reproducing means.

4. The instrument as defined in claim 1 additionally comprising a removable tab attached to said envelope portion, an informational space provided on said removable tab for inserting information relative to attempted delivery whereby said tab may be detached and left at the addressee's.

5. The instrument as defined in claim 1 additionally comprising a transparent portion in said envelope portion whereby at least a portion of the contents of said envelope portion may be viewed.

* * * * *